United States Patent [19]

Willenbacher

[11] 4,126,097

[45] Nov. 21, 1978

[54] SEWING MACHINE HAVING A GUIDING DEVICE FOR THE PRODUCTION OF EDGE-PARALLEL SEAMS

[75] Inventor: Erich Willenbacher, Rheinstetten, Fed. Rep. of Germany

[73] Assignee: Pfaff Industriemaschinen GmbH, Fed. Rep. of Germany

[21] Appl. No.: 802,314

[22] Filed: Jun. 1, 1977

[30] Foreign Application Priority Data

Jun. 18, 1976 [DE] Fed. Rep. of Germany ..... 2627520

[51] Int. Cl.[2] ..... D05B 35/10

[52] U.S. Cl. ..... 112/153

[58] Field of Search ..... 112/153, 203, 152, 150, 112/148, 136, 272, 205, 139

[56] References Cited

U.S. PATENT DOCUMENTS

| | | | |
|---|---|---|---|
| 3,182,619 | 5/1965 | Sally | 112/153 X |
| 3,782,310 | 1/1974 | Stockel | 112/153 |
| 3,905,316 | 9/1975 | Mall | 112/153 |
| 3,924,550 | 12/1975 | Boser et al. | 112/272 X |

*Primary Examiner*—Peter Nerbun

*Attorney, Agent, or Firm*—McGlew and Tuttle

[57] ABSTRACT

A sewing machine for the production of edge-parallel seams on layers of sewing material which includes a reciprocating needle which is movable through a stitch-forming station and a material feed for advancing the materials in a feeding direction through the station. The guide means for the material comprises a plurality of plates arranged in spaced vertical relationship one above the other and defining at least two separate material feed paths between adjacent plates. Each feed path has its own end guide or rule for the edge of the material which extends along a line extending laterally in a feeding direction through the needle axis. The construction includes an adjustable pressure member and a counterplate for applying and releasing pressure from materials being fed which is located at a spaced location from the end guides or rulers. One of the end guides comprises a slide having an edge defining the guide which is movable by sensing means which senses the end of one or more of the materials and positions the guide accordingly.

7 Claims, 3 Drawing Figures

1
2
3
4
5
6
7
8
9
10
12
13
14
15
16
17
18
19
21
22
23
37
38
39
40
41
44
56
57
58
59
61
69
70
H
F

SEWING MACHINE HAVING A GUIDING DEVICE FOR THE PRODUCTION OF EDGE-PARALLEL SEAMS

FIELD AND BACKGROUND OF THE INVENTION

This invention relates in general to the construction of sewing machines and, in particular, to a new and useful sewing machine for the production of edge-parallel seams on layers of sewing material of any contour, with at least one cloth feed and a guiding device provided with spaced superposed plates for the separate reception of two layers of sewing material which extend laterally from a line extending laterally in a feeding direction through the needle axis and a ruler arranged in an angle to the latter and, wherein, a pressure point is provided for each layer of sewing material laterally and in front of the stitch-forming area.

DESCRIPTION OF THE PRIOR ART

For sewing or finishing trousers with knee linings, lining cuts of equal size are used for different trouser sizes for economical and manufacturing reasons. The lining, which has substantially the same contour as the trouser part, is sewn together on one length side with the edges flush with the corresponding length side of the trouser part, while the corresponding edge strip of the other length side of the lining projects over the trouser part in an amount corresponding to the respective size of the trousers and is cut-off during the sewing by the trimming device of the sewing machine. The projecting part of the lateral edge of the lining can also be distributed over both length sides of the trouser part, particularly if there is a substantial difference in size between the trouser part and the lining.

In the presently known machines of the above-described type, the lining cannot be aligned during the sewing in its contour with the projecting edge side. This results in displacements between the trousers and the lining during the sewing thereof, causing distortion and curling on the finished trousers part.

SUMMARY OF THE INVENTION

The present invention permits control of the projecting layer of sewing material in its contour, even if its lateral edge course is not identical with the edge course of the other layer of sewing material. Accordingly, the invention provides a sewing machine in which the guide is so designed that the rule assigned to one layer of sewing material can be varied in its effective position to control the contour of the edge extending laterally with regard to the edge of the other layer of sewing material. The rule assigned to one layer of sewing material is mounted on the guide for displacement transverse to the feed line of the sewing machine.

A particularly advantageous solution is to process layers of sewing material with contours extending substantially parallel in lateral spaced relationship to each other by effecting the adjustment of the rule by a driving means which can be controlled by a sensor, which determines the distance of two contours of the layers of sewing material.

A simple realization of this solution is achieved if the rule is rigidly connected with a sensor scanning the edge of the sewing material, which causes the disconnection of the driving means.

A constructionally and operatively favorable design of the drive for displacing the rule is characterized in that the rule is mounted in a sliding guide of the guiding device and is connected with a threaded sleeve which is screwed on a threaded spindle which forms the axis of a motor secured on the guiding device.

Accordingly, an object of the invention is to provide a sewing machine for the production of edge-parallel seams on layers of sewing materials of any contour with at least one cloth feed and a guiding device which is provided with plates arranged at a spaced vertical location, one above the other, to receive separately, two layers of sewing material, and which extend from a line extending laterally in a feeding direction through the needle axis with their edges arranged along rules or guides, and with a pressure point being provided for each layer laterally and in front of the stitch-forming area and, wherein, a guide assigned to one layer of the sewing material is mounted on a guiding device for adjustment transverse to the feeding direction of the sewing machine.

Another object of the invention is to provide a device wherein at least two materials are fed to a sewing machine with their edges guided along one fixed guide and another movable guide which is positioned by a sensor which senses the edges of the material of one of the layers and effects the drive of the movable guide accordingly.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
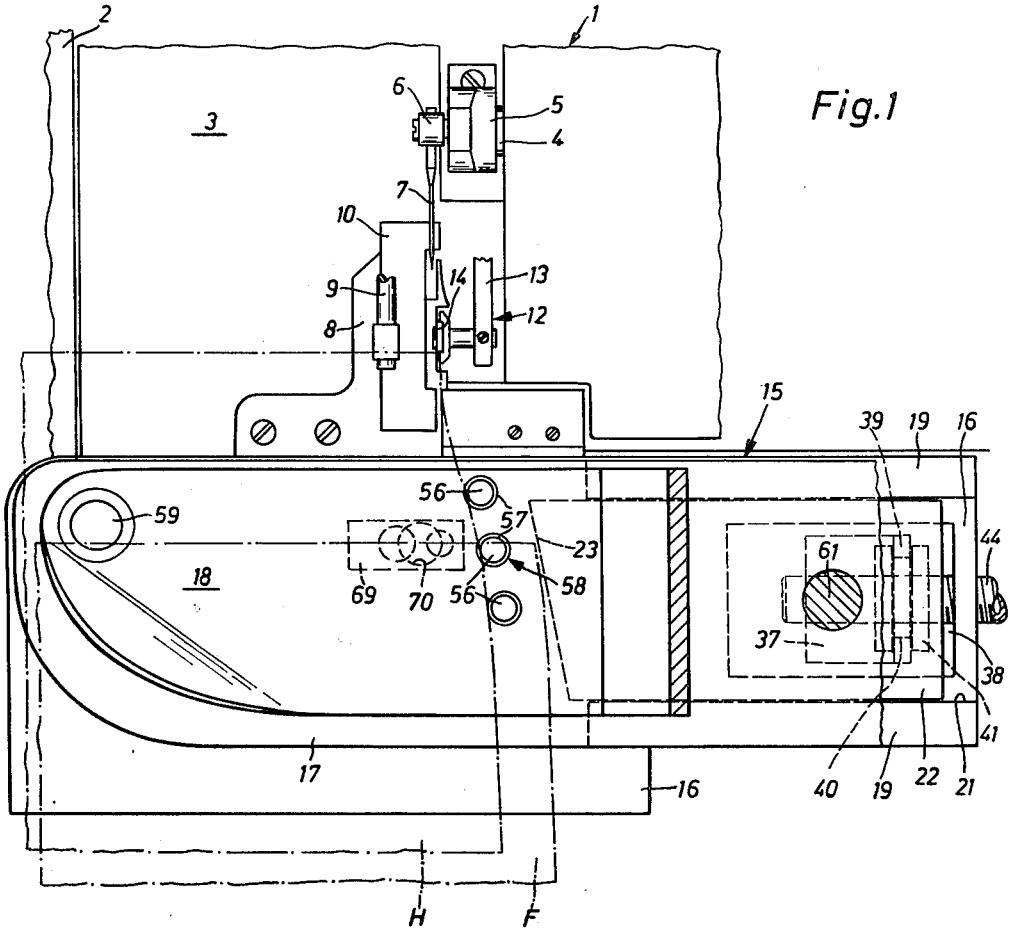
FIG. 1 is a top plan view, partly in section, of a sewing machine having a guiding device constructed in accordance with the invention.

Referring to the drawings in particular, the invention embodied therein, comprises a sewing machine which includes a needle 7 mounted for movement toward and away from a stitching area or station and which includes means 11 movable through the station for feeding the materials being stitched.

The overcast sewing machine, which is partly represented in FIG. 1, is installed in a table top 2. The machine includes a baseplate 3, a swing shaft 4 and an arm 5 secured on swing shaft 4 with a needle holder 6. A curved needle 7, in needle holder 6, is secured above a stitch plate 8, which is inserted into baseplate 3. A sewing foot 10 is secured on a bar 9 and is arranged to displace the layers of sewing material during sewing. A cloth feed 11, which engages the layers of sewing material through recesses (not shown) in stitch plate 8 displaces layers of sewing material during sewing. Sewing machine 1 is equipped with a cloth trimming device 12 which has a swing lever 13 and a knife 14. An edge of the stitch plate 8, which is designated as a knife edge, serves as a counter-cutter.

A guiding device 15 includes a bottom plate 16, a center plate 17 and a top plate 18. Bottom plate 16, which rests on table top 2, in connected with center plate 17 over lateral spacer bars 19 which are only half as long as bottom plate 16. According to FIG. 2, the left half of center plate 17 is thus in a distance above bottom plate 16 and a passage 20 is formed between plates 16 and 17.

Spacer bars 19 form a slide guide 21 (see FIG. 1) for a slide 22, arranged between the plates 16 and 17, which terminates passage 20 on the right side. The edge of slide 22 protruding through passage 20 forms, for a lining F between the two plates 16 and 17, a rule or guide edge 23, on which the edge of lining F bears. Rule or guide edge 23 extends laterally, and at an angle to a line extending through the needle axis in the feeding direction of the sewing material.

A lower pressure piece 24 (FIG. 2), for the information of a pressure point for lining F is provided, which is displaceably received in a guide bush 24, screwed in table top 2. Pressure piece 2 is dome-shaped at the end which comes in contact with the sewing material, and protrudes from the bottom through an elongated recess 26 in bottom plate 16. Pressure piece 24 carries a cross-pin 27 in the range of its lower end, which cooperates with a fork piece 30 carried by the piston rod 28 of an air cylinder 29, which has an inclined surface 31 on its underside. Air cylinder 29 is carried by a holding angle 32 secured under table top 2.

In order to be able to adjust the pressure of the lower pressure piece 24, the latter is provided with a cross-pin 33, which slides along an elongated slot 34 of guide bush 24. One end of a spring 35 bears on cross-pin 33 and its other end bears against an adjusting nut which is screwed into guide bush 25, so that the pressure of pressure piece 24 can be varied by varying the screw-in depth of adjusting nut 36.

Slide 22 is connected with an angle plate 37 which projects through a recess 38 (see also FIG. 1) in a bottom plate 16 down through a cut-out in table top 2. Angle plate 37 has a free end with a fork 39 which engages a connecting link guide 40 of a threaded sleeve 41 equipped with a threaded bore.

Figure 2:
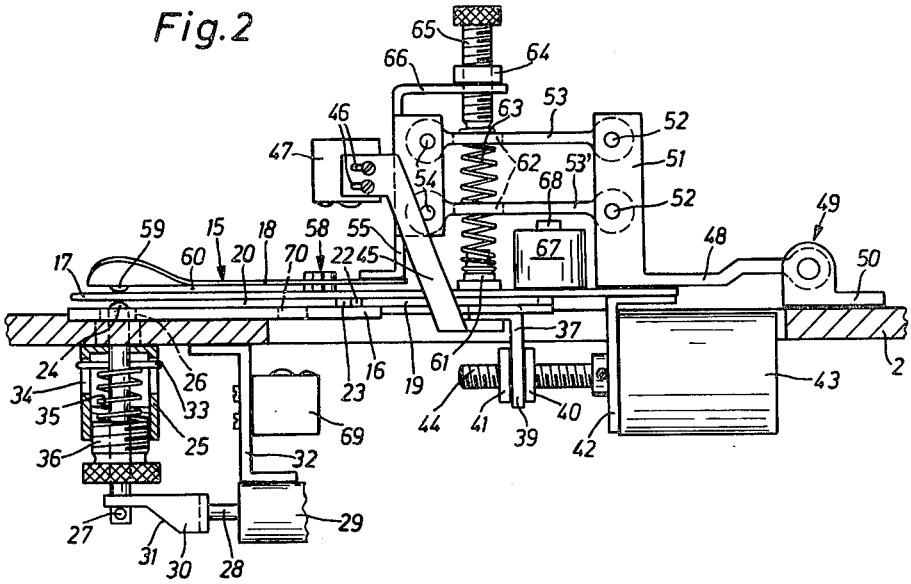
FIG. 2 is a front elevational view of the guiding device.
Figure 3:
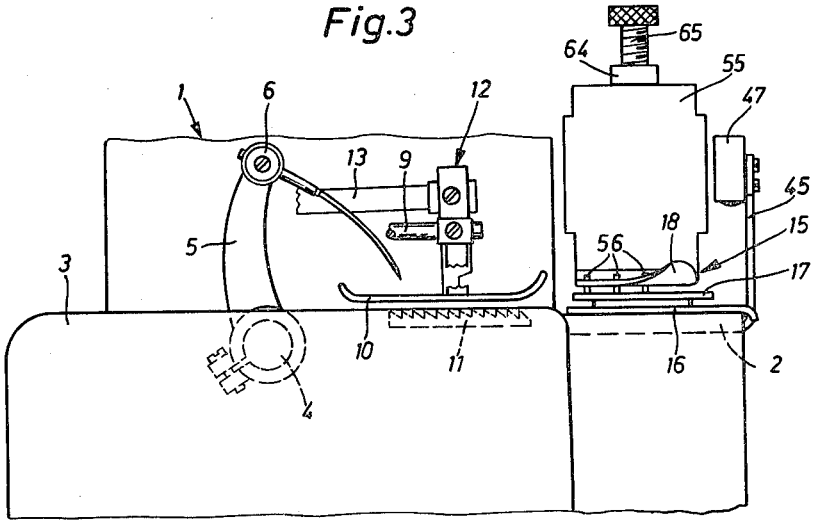
FIG. 3 is a side elevational view of the guiding device.

Extending to the right with regard to plate 16 in FIG. 2, a supporting angle 42 is screwed under plate 17, on which is secured a motor 43, whose shaft protrudes through an opening, which has not been shown, in supporting angle 42. A hollow threaded spindle 44 which is screwed into the threaded bore of threaded sleeve 41 is secured on the shaft. A holder 45 is secured on angle plate 37, which projects forward under bottom plate 16 and is then bent upward. At its upper end, holder 45 carries a reflecting light barrier or photoelectric control element 47 which is mounted for adjustment in elongated slots 46 on the holder and which cooperates with the top side of bottom plate 16 as a reflecting surface, as shown in FIG. 3. According to FIG. 2, an offset hinge plate 48 of a hinge 49 is secured on the righthand side of center plate 17, whose other hinge plate 50 is secured on table top 2. A support 51 is rigidly connected with hinge plate 48, on which two guide rods 53 and 53' arranged parallel one above the other, are articulated and which carry a holder 55, over two additional pins 54, having a bent-off lower end which is secured to top plate 18.

Several vertical upright cylindrical pins 56 which protrude through corresponding openings 57 of top plate 18 are secured in center plate 17 (FIG. 1). The pins 56 form a rule or guide 58 for a trouser part H, between the two plates 17 and 18, on which the edge of trouser part H bears. Here, the pins 56 are arranged on a line which extends laterally and in an angle to a line extending through the needle axis in the feeding direction of the sewing material. On the underside of top plate 18, on the side of the line extending in the feeding direction through the needle axis, opposite the pins 56, there is arranged a flat curved pressure piece 59 which forms a pressure point for the trouser part H. On the front side in the feed direction of the sewing material, top plate 17 is bent obliquely upwardly so that the entrance of the trouser part H into passage 60 between the two plates 17 and 18 is facilitated (FIG. 2).

A bolt 61 is secured in the center plate 17 to the right of pins 56 (related to FIG. 2). A coil spring 63 is engaged over bolt 61 and protrudes through corresponding openings 62 of the two guide rods 53 and 53'. Coil spring 63 is biased with its upper end on the cylindrical end piece of an adjusting screw 65 which is screwed into a threaded bush 64. Threaded bush 64 is carried by a lug 66 connected with holder 55.

An air cylinder 67, whose piston rod 68 bears in the extended state against the bottom guide rod 53', is secured on center plate 17, and lifts the latter against the action of coil spring 63. A reflecting light barrier or photoelectric control element 69, which cooperates through an opening 70 in bottom plate 16 with the underside of center plate 17 as a reflection surface, is secured under table top 2 on supporting angle 32.

The mode of operation of the arrangement is as follows:

When sewing or finishing the edges of trousers with knee linings, it was found expedient, as mentioned above, to use lining cuts of equal size for different sizes of trousers, which are substantially identical in their contours with the lateral contour course of the trouser parts. The lining can have the same length as the trouser part. However, in most cases, the lining is only provided as an actual "knee lining", and is therefore much shorter than the trouser part. The procedure in sewing a shorter lining is set forth hereinafter. This procedure does not, however, differ principally from sewing trouser parts and linings of equal length. In both types, the lining F is inserted into the guiding device 15 under the trouser part H.

Before inserting the trouser part H, air cylinder 67 extends piston rod 68, which presses from the bottom on the lower guide rod 53' so that top plate 18 is lifted from center plate 17. The trouser part H is then inserted in the passage 20 which is increased this way, and aligned with its front lateral edge on pins 56. Then piston rod 68 is retracted, so that coil spring 63 presses top plate 18 down. The trouser part H can now be pulled between the plates 17 and 18, but pressure piece 59 brakes the movement of the trouser part H.

During sewing, cloth feed 11 exerts a tensile force in the feeding direction on the trouser part H, and imparts the usual feeding movement to it. Due to the tensile force exerted on trouser part H and the braking action of pressure piece 59, the trouser part H performs a rotary movement about a vertical axis, in a known manner. The edge of trouser part H is turned toward rule 58, formed by pins 56, by this rotary movement, and is then moved along the latter. This way, the trouser part H is fed to the stitch-forming area aligned in its contour.

The pressure required on pressure piece 59 to produce the braking action is produced by coil spring 63. Coil spring 63 is designed as a combination tension-compression spring and acts so that it can be either stretched or compressed, starting from a certain position in which it is in equilibrium. Additionally, the weight of top plate 18 can be absorbed by spring 63, that is, for extremely thin and delicate materials, the state of tension of coil spring 63 can be so varied that top plate 18 hovers in an adjustable position lifted from center plate 17. In this position, the coil spring 63 no longer presses on top plate 18, but exerts a lifting force on it which corresponds to the weight of plate 18. In this way, the desired distance between the plates 17 and 18 can be adjusted by turning adjusting screw 65. This has the advantage that the thin and flexible trouser part H has no chance to bend or roll on pins 56 on which it is pressed by the aligning action of the guiding device 15.

The contour of the trouser part H is finished in this manner until the front edge of lining F, arranged in the knee region of the trouser part H, enters passage 20 below the trouser part H and arrives there in the range of reflecting light barrier 69, as shown in FIG. 1. Reflecting light barrier 69 now causes a disconnection of the sewing maching 1 and thus interrupts the movement of trouser part H through the cloth feed 11.

At the same time, reflecting light barrier 69 starts the drive of motor 43 which sets threaded spindle 44 in rotation so that the latter moves threaded sleeve 41 and thus also slide 22 from the right end position to the left. The holder 45 is also shifted so that reflecting light barrier 47 is also displaced. The light barrier 47 is so adjusted with regard to slide 22 that when it senses the edge of lining F, slide 22 just bears on the edge of the lining. When reflecting light barrier 47 senses the lateral edge of lining F, it causes the disconnection of motor 43 and the connection of sewing maching 1. In addition, it causes the retraction of piston rod 28 by air cylinder 29, so that pressure piece 24 bears against the lining from the bottom.

Sewing machine 1 now performs the further sewing operation, where the edge of lining F is turned by the braking action of pressure piece 24 toward rule or guide 23 and is moved along the latter. In this way, the lining F is fed to the stitchforming area, aligned in its contour, where the marginal strip of lining F projects over trouser part H by an amount depending upon the respective size of the trousers which is cut-off during the sewing by the trimming device 12.

At the end of the sewing operation, reflecting light barrier 69 starts the drive of motor 43 in the opposite direction when it senses the rear edge of lining F. The threaded spindle 44 then moves the slide 22 back into its righthand end position. At the same time, reflecting light barrier 69 causes the extension of piston rod 28 from air cylinder 29, so that pressure piece 24 is displaced downwardly, placing inclined surface 31 on pin 27.

The deformations which appear during sewing between lining F and trouser part H by the one-sided movement of cloth feed 11 acting on the lining F and by the simultaneous braking of the trouser part H by sewing foot 10 can be eliminated to a great extent due to the above-described measures. Beyond that, a desired measure of overwidth of lining F in the transverse direction can be obtained by corresponding adjustment of reflecting light barrier 47 in oblong slots 46, to prevent unsightly appearance of the finished trousers by shrinkage of lining F in a later treatment.

While a specific embodiment of the invention has been shown and described in detail to illustrate the application of the principles of the invention, it will be understood that the invention may be embodied otherwise without departing from such principles.

What is claimed is:

1. A sewing machine for the production of edgeparallel seams on layers of sewing materials which includes a reciprocating needle movable through a stitch-forming station and a material feed for advancing the material in a feeding direction through the stitch-forming station, comprising a plurality of plates arranged in spaced vertical relationships one above the other and defining at least two separate material feed paths, each path being defined between two adjacent plates, first and second end guides disposed between respective plates in respective material feed paths defining end guides for the respective materials along a line extending laterally in a feeding direction through the needle axis, means defining a pressure point for engagement with each layer laterally and in front of the stitch-forming station, a guiding device carrying one of said first and second end guides, and means mounting said one end guide in said guiding device for adjustment transverse to the feeding direction, said guiding device including a movable slide, drive means for moving said slide, and sensor means for sensing the spacing between the edges on one side of the layers of material.

2. A sewing machine, according to claim 1, including a threaded spindle connected to said drive motor which is rotated thereby, a sleeve guided on said threaded spindle being advanced thereon upon rotation of said spindle connected to said slide for moving said slide backwardly and forwardly in accordance with actuation of said motor.

3. A sewing machine for the production of edge-parallel seams on layers of sewing materials which includes a reciprocating needle movable through a stitchforming station and a material feed for advancing the material in a feeding direction through the stitch-forming station, comprising a plurality of plates arranged in spaced vertical relationship one above the other and defining at least two separate material feed paths, each path being defined between two adjacent plates, first and second end guides disposed between respective plates in respective material feed paths defining end guides for the respective materials along a line extending laterally in a feeding direction through the needle axis, means defining a pressure point for engagement with each layer laterally and in front of the stitch-forming station, a guiding device carrying one of said first and second end guides, and means mounting said one end guide in said guiding device for adjustment transverse to the feeding direction, wherein said sensing means being connected to said drive motor to stop said drive motor when one of said materials is sensed.

4. In a sewing maching including a needle mounted for reciprocating movement toward and away from a stitching area and means for feeding materials through the stitching area, the improvement comprising, a guide device for feeding a plurality of materials to the stitching area, said guiding device comprising a bottom plate located alongside the stitching area over which a first material is fed, a middle plate overlying and spaced above said bottom plate, a top plate overlying and spaced above said bottom plate, a top plate overlying and spaced above said middle plate, the space between said bottom and middle plates defining a first feed path for a first material, the space between said middle plate and said top plate defining a second feed path for a second material, first end guide means defining a first material end guide in said first feed path with a guide edge extending along a line extending laterally in a feeding direction through the needle axis, second end guide means defining a second end guide line extending laterally in a feeding direction through the needle axis, sensing means for sensing the position of the edges of said material, pressure-applying means engageable with said materials at a spaced location from said first and second end guide lines and said stitching station, motor means connected to said first material end guide and said sensing means and said pressure-applying means for moving said first material and guide to a guide position and for actuating said pressure-applying means.

5. In a sewing machine, the improvement claimed in claim 4, wherein said pressure-applying means includes a counterpoint formed on said top plate, adjustable means for applying pressure to said top plate counterpoint and a pressure piece mounted for upward and downward movement below said counterpoint, and means connected to said pressure piece for selectively moving it upwardly an downwardly.

6. In a sewing machine, the improvement claimed in claim 5, wherein said means connected to said pressure piece includes a drive member connected to said sensing means.

7. In a sewing machine, the improvement as claimed in claim 5, including a combination compression and tension spring, means supporting said top for hinged upward and downward movement, said spring being engageable with said top pressure plate, and adjustment means between said plate and said spring for varying the tension and compression force acting on said plate.

* * * * *